US008227345B2

(12) United States Patent
Matusch

(10) Patent No.: US 8,227,345 B2
(45) Date of Patent: Jul. 24, 2012

(54) HIGH CAPACITY ANODE PREPARATION APPARATUS

(76) Inventor: Stephan Frank Matusch, Lively (CA)

( * ) Notice: Subject to any disclaimer, the term of this patent is extended or adjusted under 35 U.S.C. 154(b) by 683 days.

(21) Appl. No.: 12/516,144

(22) PCT Filed: Nov. 16, 2007

(86) PCT No.: PCT/CA2007/002089

§ 371 (c)(1),
(2), (4) Date: May 22, 2009

(87) PCT Pub. No.: WO2008/061354

PCT Pub. Date: May 29, 2008

(65) Prior Publication Data

US 2010/0058567 A1 Mar. 11, 2010

(30) Foreign Application Priority Data

Nov. 22, 2006 (CA) ..... 2568484

(51) Int. Cl.
*H01L 21/44* (2006.01)

(52) U.S. Cl. ..... 438/678; 29/25; 205/44

(58) Field of Classification Search ..... 29/25–30; 438/678; 205/44, 182
See application file for complete search history.

(56) References Cited

U.S. PATENT DOCUMENTS 3,648,758 A 3/1972 Kreuz et al.
3,938,672 A 2/1976 Leiponen et al.
4,267,877 A 5/1981 Leiponen et al.
4,411,146 A 10/1983 Sulasaari et al.
4,741,377 A 5/1988 Roberti et al.
4,880,506 A * 11/1989 Ackerman et al. ..... 205/44
4,903,519 A 2/1990 Hukkanen et al.
4,946,575 A 8/1990 Dompas
4,998,579 A 3/1991 Mawer et al.

(Continued)

FOREIGN PATENT DOCUMENTS

CA 1234780 4/1988
WO WO 9742360 11/1997

OTHER PUBLICATIONS

Outokumpu, Fire Refining and Anode Casting, www.outokumputechnology.com/pages/Page_6901.aspx (2 pages).

(Continued)

*Primary Examiner* — Thao P. Le
(74) *Attorney, Agent, or Firm* — Gerald A. Gowan; Gowan Intellectual Property

(57) ABSTRACT

A high capacity anode preparation apparatus is provided which allows for the processing of raw anodes at production rates of up to, or exceeding, 600 anodes per hour. The processed anodes are suitable for use in the electrorefining of various metal materials, but in particular, in the electrorefining of copper. The apparatus is preferably part of a system which utilizes high speed industrial robots to supply, and remove, anodes to or from the apparatus, and provides the anodes in a horizontal orientation. The apparatus is equipped with a variety of treatment stations which are adapted to treat the raw anode while it is held in a horizontal orientation. The horizontal orientation allows the center of gravity for the apparatus to be kept close to the center of gravity for the apparatus, and thus allows the apparatus to rotate more rapidly than prior art device. Faster processing of the raw anodes is provided.

31 Claims, 3 Drawing Sheets

U.S. PATENT DOCUMENTS

| | | | | |
|---|---|---|---|---|
| 5,064,051 | A | 11/1991 | Blundy | |
| 5,149,410 | A | 9/1992 | Robinson et al. | |
| 5,421,072 | A | 6/1995 | Kuban | |
| 5,543,028 | A | 8/1996 | Herbert et al. | |
| 5,799,529 | A | 9/1998 | Kivisto et al. | |
| 6,632,345 | B1 * | 10/2003 | Chen | 205/182 |
| 6,821,405 | B1 | 11/2004 | Marttila | |
| 6,919,013 | B2 * | 7/2005 | Chen | 205/182 |
| 7,002,171 | B2 | 2/2006 | Rantala et al. | |
| 7,014,036 | B2 | 3/2006 | Robinson et al. | |
| 7,067,423 | B2 * | 6/2006 | Ohara | 438/678 |
| 2004/0050660 | A1 | 3/2004 | Lumppio | |

OTHER PUBLICATIONS

XSTRATA Technology, Technology, www.xstratatech.com/en/t_isa_process_technology.html (6 pages).

Canadian Copper; "CCR Tankhouse Modernization"; Issue 142, 1999.

* cited by examiner

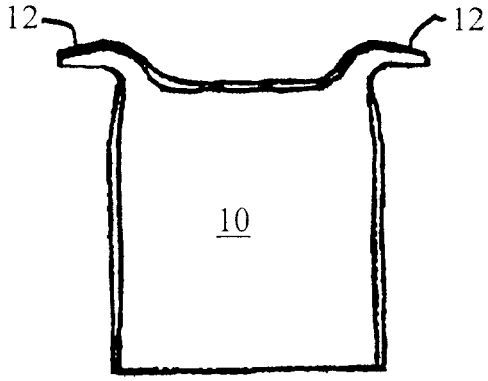
FIG. 2
FIG. 3
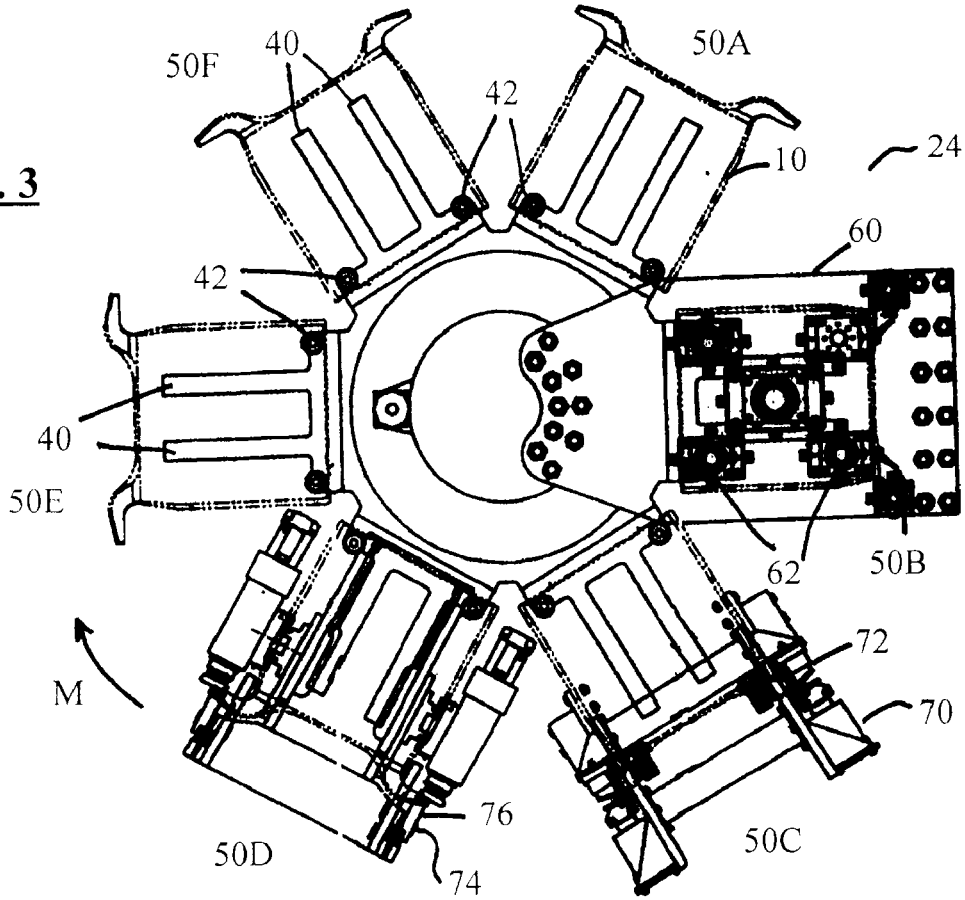

HIGH CAPACITY ANODE PREPARATION APPARATUS

CROSS REFERENCE TO RELATED APPLICATIONS

This application is derived from PCT application No. PCT/CA2007/002089, filed Nov. 16, 2007, which claimed priority to Canadian Patent Application No. 2568484, filed Nov. 22, 2006, the entire contents of each application being expressly incorporated herein by reference.

FIELD OF THE INVENTION

The present invention relates to the field of anode preparation, and in particular, relates to an apparatus which is adapted to quickly conduct a series of anode preparation operations in order to provide high anode output levels.

BACKGROUND OF THE INVENTION

The final refining of several metals, such as, for example, copper, is carried out with electrolysis. This electrorefining process uses dissolvable anodes which are produced by casting molten metal into anode molds. The formed anodes are immersed in the electrolytic cells and are suspended therein by "lugs" formed at the upper end of the anode. On top of the first side wall of each cell, there is a busbar, and on top of the second side wall there is provided insulation. The anode lugs rest on the busbar and the insulation. The high electric current in the cell proceeds via the contact with the busbar and the anode lugs.

A cathode of another metal, such as stainless steel is also immersed in the cell, and also has lugs which rest on a second busbar and insulation. During the electrorefining process, metal from the anode dissolves into the electrolytic, and is then subsequently deposited onto the anode in a more purified state. Through this operation, the purity of the metal can be raised to 99.9% or higher, and the contaminant materials present in the original cast anode typically settle to the bottom of the cell where they can be removed. The electrorefining operation, utilizing electrolytic cells, is well known in the art, and a detailed discussion of that process is outside of the scope of the present invention.

However, it is to be noted that a typical metal anode is commonly approximately 1 meter square in size, and can be anywhere from 2 to 10 cm, or more, thick. The anode is usually formed by casting molten metal into a suitable mould and then allowing the metal to cool and solidify. Alternatively, the anode can be cut from a continuous casting of material.

Typically, an anode can weigh between 200 and 400 kg, and thus, handling and movement of the anode during anode preparation can be difficult. Further, in a large scale metal mine, the number of anodes needed can also be fairly large. For example, in some mines, over a million anodes are required in a given year.

As such, it is necessary to have high anode production rates. Initially, formation of the raw anode is commonly done by casting the molten metal material into horizontal moulds provided on a casting wheel, or the like, or by having a rotating series of vertical moulds. Again, though, the actual techniques for the production of the raw metal anodes are well known in the art, and therefore, are also outside of the scope of the present invention.

However, while a large number of raw metal anodes can be prepared using the prior art techniques, in order to ensure optimal efficiency in the electrolytic cell, it is still necessary to conduct several anode preparation operations on the raw anode, as cast, in order to provide an anode suitable for use in the electrolytic cell.

For example, in order to gain maximum electrical contact and consequently minimum electricity losses, the bottom surfaces of the anode lugs are commonly milled, smoothed and/or cleaned in order to be flat and perpendicular to the anode end surface. This is necessary to maximize contact with the busbar and ensure that the anode hangs substantially perfectly vertical in the electrolytic cell. The lugs might also need to be bent and/or straightened to be parallel to the front or back anode surfaces.

Further, the anodes surfaces are commonly rolled or hydraulically pressed in order to minimize thickness variations between anodes and/or across the surface of the anode itself. These variations in the anode thickness might be caused by acceleration or deceleration of the casting wheel, having a non-level casting mould, or having a heat-warped casting mould.

Further still, the surface of the anode may be ground or milled in order to provide patterns on the anode that will reduce the chances of breakage of the anode during handling or use, or to provide patterns which can influence the ultimate rate and anode dissolution profile. The anode might also be milled so as to provide a thinner top section that will allow the anodes to be moved closer to one another as the anode dissolves in the electrolytic process.

Alternatively, or additionally, a thicker section in the upper portion of an electrode might be provided on the anode, between the lugs. This thicker section may be necessary to ensure that there is sufficient metal left after the electrorefining process in order to prevent buckling between the lugs as the remaining anode is removed from the electrolytic cell. If an anode buckles or breaks as it is being removed, it can present a serious safety hazard and/or can cause significant damage to equipment.

Still further, it may be necessary to grind or mill off extraneous casting "fins" or "flash" material formed at the edges of the mould. Other processes steps might also be required depending on the specific electrorefining process utilized.

As such, it is clear that processing of the raw, cast anode prior to use is typically desirable in order to maximize the efficiency of the electrolytic cell.

Currently, after casting, the anodes are commonly hung on a rack in a vertical fashion by their lugs. They are then processed by being moved on a conveyor system from treatment station to treatment station where the various operations are individually conducted on the vertical anodes. This anode processing technique is typically designed so as to be capable of handling 200 to 300 anodes per hour (APH). However, given the production rates of some mines, these anode treatment process rates are inadequate, and therefore two or more treatment lines may be required to meet production needs.

Higher anode production capacity processing designs are also currently known. These high capacity (greater than or equal to 450 APH) anode preparation systems are available in two different formats, namely linear systems and carousel systems.

In a high capacity linear system, the anodes are moved along a track while hanging in a vertical orientation. They are also transferred in a vertical orientation, laterally between operation stations. The linear system is typically chain driven and, in practice, is limited to a capacity of 500 APH.

Additionally, in a linear system, clamping of the anodes is less positive, and is more prone to anode mis-positioning as the chain wears. As such, the linear process can be inaccurate. Further, when installed, the linear system is fairly large so that is is typically delivered in sections and requires significant millwrighting during installation. The linear system also typically requires connection to an external hydraulic system. Further, the linear system is very rigid, in that the anodes incoming and outgoing must maintain the same vertical orientation throughout the process.

In the high capacity carousel systems, the anodes are transferred from the feed rack to various processing operation stations which are provided in a carousel arrangement. However, again, the anodes are processed while being maintained in a vertical orientation. As such, the anodes are maintained in a vertical orientation as they pass through each operation around the carousel, and then placed back onto an output rack while still in the vertical orientation.

To allow room for the processing equipment at each operational station on the carousel, the anodes must be kept at a distance from the centre of the carousel. As such, this required distance from the centre of the carousel provides significant mechanical disadvantages, as will be discussed hereinbelow. Further, existing carousel systems are also fairly large systems which again are shipped as a number of separate assemblies to be field installed. Again, this typically requires a significant amount of field millwrighting, and commonly the connection of hydraulic services. In practice, the carousel systems are generally limited to 450 APH.

To overcome the difficulties of known high capacity anode treatment processes, it would advantageous to provide an improved process and apparatus to facilitate the processing of metal anodes in order to prepare them for use in electrorefining. It would also be desirable to provide a process and apparatus which would allow the anode preparation processes to be done in a relatively small area, and to be done rapidly. Further, it would also be desirable to provide a process and apparatus that was suitable for automation in order to minimize worker involvement in a loud and potentially dangerous operation of handling, milling, grinding, and pressing the large and heavy anodes in rapid succession. Still further, it would be desirable to provide such a process and apparatus that could achieve production rates in excess of 300, and more preferably, in excess of 450 or 500 anodes per hour, or even higher.

SUMMARY OF THE INVENTION

Accordingly, it is a principal advantage of the present invention to provide a process and apparatus that can overcome or ameliorate these difficulties. These advantages, as well as other objects and goals inherent thereto, are at least partially or fully provided by the process and apparatus of the present invention, as set out herein below. In particular, the system of the present invention overcomes the problems of the prior art high capacity system by providing a novel method and apparatus for transferring anodes between various operations.

Accordingly, in one aspect, the present invention provides an electrorefining anode preparation apparatus comprising a base, a moveable rotating platform and drive means for rotating the platform relative to said base, in a controlled fashion;

an anode receiving means on said platform which is adapted to receive and hold a raw metal anode in an essentially horizontal orientation, and present said anode to an anode treatment station in a horizontal orientation;

one or a plurality of anode treatment stations located around said rotary platform, whereby said anode can be progressively moved, in series, from said anode receiving means to any or all of said anode treatment stations, in an essentially horizontal orientation, in order to prepare a processed anode;

an anode discharge means on said platform which is adapted to receive said processed anode from anode treatment stations, and discharge said processed anode from said anode preparation apparatus in an essentially horizontal orientation.

The raw anodes are typically supplied to the anode preparation apparatus using a conveyor system wherein the anodes are hung by their lugs in an essentially vertical orientation. Similarly, the processed anodes are typically forwarded to the electrolytic cell using a conveyor system wherein the processed anodes are hung by their lugs in an essentially vertical orientation.

As such, the present invention also preferably provides an anode receiver for receiving a raw anode in an essentially vertical orientation from a first conveyor system comprising means for grasping and holding a raw anode on said first conveyor system; means for rotating said held raw anode from said essentially vertical orientation to an essentially horizontal orientation; and means for transferring the horizontally orientated raw anode to said anode receiving means on said anode preparation apparatus.

Similarly, the present invention also preferably provides an anode discharger for discharging a processed anode from said anode preparation apparatus comprising means for grasping and holding an essentially horizontal, processed anode from said anode discharge means on said anode preparation apparatus; means for rotating said held processed anode from an essentially horizontal orientation to an essentially vertical orientation; and means for transferring the vertically orientated process anode to a second conveyor system.

Accordingly, in a further aspect, the present invention also provides an anode processing system comprising an anode receiver, an anode preparation apparatus, and an anode discharger, as described hereinabove with respect to the present invention.

Preferably, the anode receiver and the anode discharger are both automated, robotic devices fitted with grasping and holding arms capable of grasping and holding a raw or processed anode, means for rotation of said raw or processed anodes from an essentially vertical orientation to an essentially horizontal orientation, or vice versa, and means to move said raw or processed anode between said anode preparation apparatus and said first or second conveyor systems.

In a still further aspect, the present invention also provides an electrorefining anode preparation process comprising;

presenting an essentially vertically orientated raw anode from a first conveyor system to an anode receiver;

grasping and holding said raw anode with said anode receiver;

rotating said raw anode to an essentially horizontal orientation and presenting said horizontally orientated raw anode to an anode preparation station;

receiving and holding said raw anode on a platform on said anode preparation station using an anode receiving means;

rotating said platform to move said raw anode, in series, from said anode receiving means to one or a plurality of anode treatment stations;

treating said raw anode in said anode treatment stations, while said raw anode is in an essentially horizontal orientation, in order to produce a processed anode;

rotating said platform to move said processed anode to an anode discharge means;

grasping and holding said processed anode from said anode discharge means using an anode discharger;

rotating said processed anode to an essentially vertical orientation and preparation station;

discharging said processed anode, in an essentially vertical orientation, from said anode discharger to a second conveyor means.

DETAILED DESCRIPTION OF THE INVENTION

In the present application, the term "electrorefining" refers to a metal production method characterized by the purification of a metal using an electrolytic cell. The present application is primarily directed to the use of the electrorefining of copper, and as such, the remaining discussion will be directed primarily to the treatment and processing of a raw, copper anode in order to prepare a processed copper anode suitable for use in an electrolytic cell. However, the skilled artisan will be aware that other metals, such as silver, gold, tin, nickel, cobalt, lead, zinc, or the like might also be used. Accordingly, while the following discussion is described with particular reference to a copper anode, the skilled atisan would be aware that the present application is equally applicable for other metals.

BRIEF DESCRIPTION OF THE DRAWINGS

Embodiments of this invention will now be described by way of example only in association with the accompanying drawings in which:

FIG. 2 is a perspective drawing of a copper anode;

FIG. 3 is an enlarged view of the rotary anode preparation apparatus, shown in part, in FIG. 1.

DETAILED DESCRIPTION OF THE PREFERRED EMBODIMENTS

Figure 1:
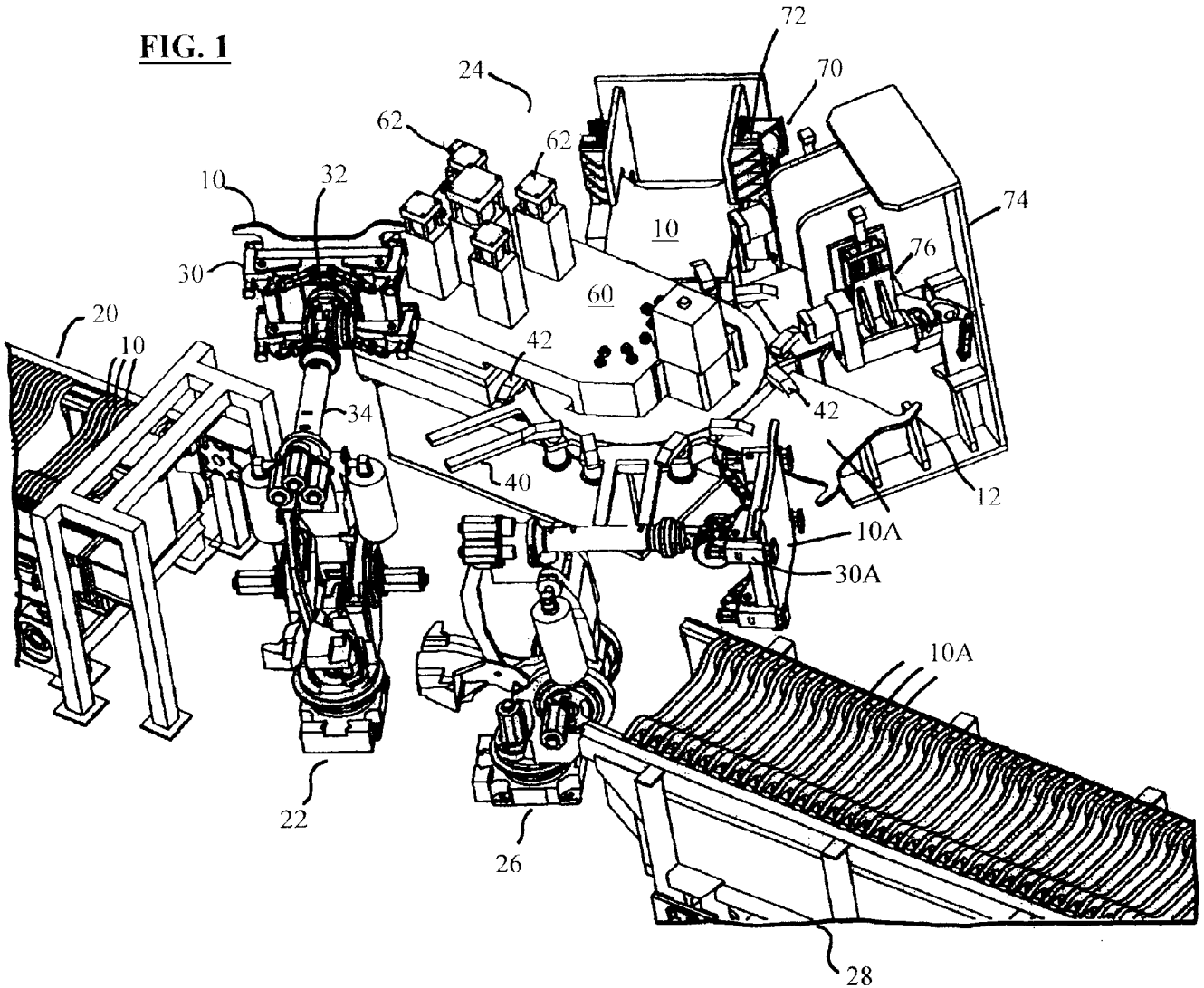
FIG. 1 is a perspective, overhead drawing of a production line of the process of the present invention.

The novel features which are believed to be characteristic of the present invention, as to its structure, organization, use and method of operation, together with further objectives and advantages thereof, will be better understood from the following drawings in which a presently preferred embodiment of the invention will now be illustrated by way of example only. In the drawings, like reference numerals depict like elements.

It is expressly understood, however, that the drawings are for the purpose of illustration and description only and are not intended as a definition of the limits of the invention.

Figure 4:
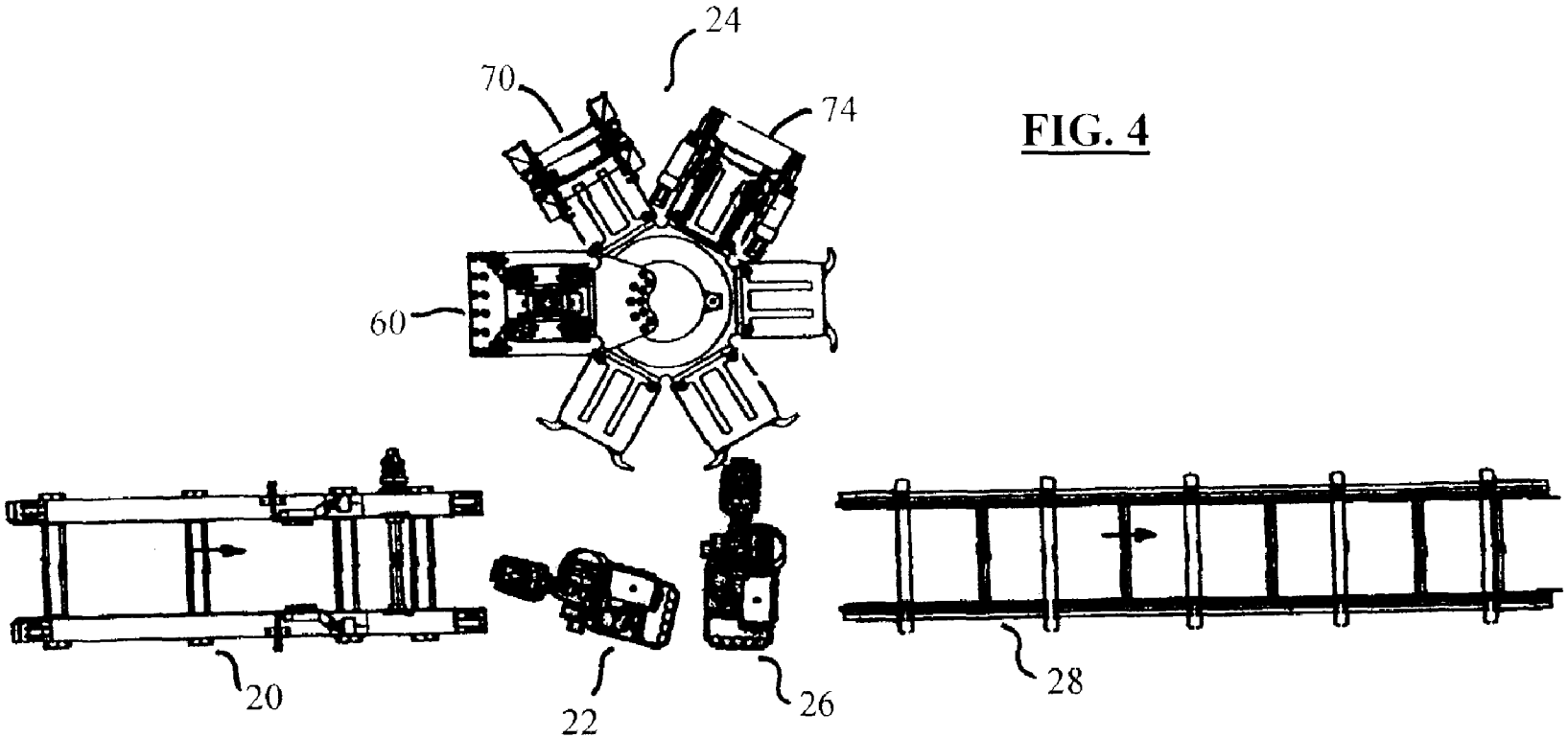
FIG. 4 is a top view of the production line shown in FIG. 1.

In FIGS. 1 and 4, an anode processing system is shown having a receiving conveyor 20, as a first conveyor, an anode receiver 22, an anode preparation apparatus 24, an anode discharger 26, and a discharge conveyor 28, as a second conveyor. The system is used to process the raw copper anodes 10, as shown in more detail in FIG. 2. Anode 10 is shown having two lugs 12 at an upper edge. Anode 10 has been form by casting molten copper in a mould on a casting wheel, and is roughly 1 meter across and high, and has a thickness of 5 cm. The anode weighs roughly 300 kg.

Conveyors 20 and 28 can be any suitable conveyors which can handle the weight of the raw anodes 10, or of a processed anodes 10A. For example, a chain driven conveyor will be suitable.

At one end of receiving conveyor 20 is anode receiver 22 which is adapted to grasp and hold a single electrode 10 from an end of receiving conveyor 20. Raw anodes 10 can be supplied from a storage location, or directly from a raw anode production unit. Anode receiver 22 is a programmable industrial robot having hydraulically operated arms 30 which can be used to grasp and hold a single raw anode 10. Anode receiver 22 also has a rotatable joint 32 which permits raw anode 10 to be moved from the vertical position, as found on conveyor 20 to an essentially horizontal position (not shown). A telescopic arm 34 allows the raw anode to be moved to a position adjacent to apparatus 24, and then placed on a pair of support arms 40 extending radially from apparatus 24. The raw anode 10 is held in place on support arms 40 with hydraulically operated anode clamps 42. Once a raw anode 10 is placed on support arms 40, anode receiver 22 releases the raw anode 10, returns arms 30 to a vertical orientation, and then returns to the end of receiving conveyer 20, ready to accept the next raw anode 10.

The cycle time to grasp a raw anode, place it on support arms 40 of apparatus 24, and return to the end of receiving conveyor 20, is less than 6 seconds.

As best seen in FIG. 3, apparatus 24 has six sets of support arms 40, and thus has six stations roughly 60° from each other. Apparatus 24 can rotate so as to move from one station to the next in 1.2 seconds. Apparatus 24 can be powered by any suitable motor or device, but in this embodiment, is a high speed servo-electric motor.

When viewed from overhead, as in FIG. 3, the six stations, namely 50A, 50B, 50C, 50D, 50E and 50F, can be seen. Anode receiver 22 places anode 10, on apparatus 24, at receiving station 50A, and apparatus 24 rotates in a clockwise fashion as indicated by the directional arrow "M". For clarity, anodes 10 on apparatus 24 are shown in outline in FIG. 3.

Apparatus 24 rotates 60° to deliver raw anode 10 to its first processing station 50B, namely an anode body press 60 comprising a series of hydraulic rams 62 that press onto the body of anode 10. By the use of body press 60, the body of anode 10 is pressed to a uniform thickness, and having an essentially smooth surface (or any other desired surface texture, based on the pattern present on the walls of the hydraulic body press). The body press station takes 4.8 seconds, and apparatus 24 again rotates to move anode 10 to its second processing station 50C, namely a lug press 70.

It is to be noted that a fresh anode 10 is also provided to anode body press 60.

In lug press 70, lugs 12 on anode 10 are straightened and/or bent, as needed, using hydraulic rams 72, in order to provide lugs 12 having the desired shape and orientation. The lug press operates over a span of 3.5 seconds.

During the next rotation of apparatus 24, anode 10 is moved to station 50D, namely the lug mill station 74. In this station, the lugs 12 are milled using cutters 76, to provide a lower surface which is flat, smooth, and having the desired angle. The milling operation takes 4.8 seconds.

After lug mill station 74, the raw anode 10, has been prepared for use in the electrolytic cell, and is now a processed anode 10A. However, on the next rotation of apparatus 24, process anode 10A is moved to a spare station 50E. Spare station 50E can be fitted with any other devices needed to further process anode 10 prior to use. However, no further processing is required in this embodiment.

On the next rotation of apparatus 24, processed anode 10A is moved to its discharge station 50F where it is released from clamps 42, and is then grasped and held by arms 30A of anode discharger 26. Anode discharger 26, in this embodiment is the same type of industrial robot as anode receiver 22, but is programmed to grasp the horizontally orientated processed anode 10A from station 50F of apparatus 24, rotate anode 10A to a vertical orientation, and place it so that it hangs on discharge conveyor 28 in a vertical orientation, as shown in FIG. 1. Discharge conveyor 28 can be identical to receiving conveyor 20, and is used to transfer processed anodes 10A to a storage area, or storage rack, or even directly to an electrolytic cell. The cycle time for removal of the anode is 6 seconds, or less.

This completes the processing of the raw anodes 10.

It is to be noted that the longest processing stage is 4.8 seconds. Further, the rotation time of apparatus 24 to move 60° is 1.2 seconds. As such, a processed anode 10A is added to discharge conveyor 28 every 6.0 seconds. This discharge rate equates to a production rate of 10 processed anodes per minute, or 600 anodes per hour.

It is noted that the anodes are generally equally spaced radially around apparatus 24. This permits apparatus 24 to be essentially balanced, and allow for smooth rotation of the device. Also, it is noted that anodes 10 are placed with lugs 12 being located radially away from the centre of apparatus 24. This permits easier access to lugs 12 for processing in the lug press and lug milling operations, but also permits the centre of gravity for the anode weight on each set of support arms 40 to be as close as possible to the centre of apparatus 24 which also permits easier rotation. Further, since lugs 12 are placed radially outward from the centre of apparatus 24, it can be seen that anodes on each of the six stations can be closer to each other since the anode width, at this non-lug end, is less than the width at the lug end. Again, this orientation aids to keep the centre of gravity for each support arm close to the centre of apparatus 24.

Of course, anodes 10 can be placed in an orientation where the lugs are closest to the centre of apparatus 24, but in this case, support arms 40 would need to be extended.

Also, it should be noted that by rotating anodes 10 to a horizontal orientation, the lugs are free for easy access during the lug press and lug milling operations. However, the body of the anode is still readily available for the body press operation wherein the press components can be located above and below the anode. This facilitates the rapid movement of the anode from station to station without the need for any additional change in orientation of the anode, or for changing the mechanism for holding the anode in place. This is significant in achieving the high rotational speeds of the present invention, in that the centre of gravity of each anode is equally spaced around the center of apparatus 24, and is preferably located within 2 meters of the centre of apparatus 24. In a further preferred embodiment, the centre of gravity of each anode is preferably less than 1.5 meters from the center of apparatus 24.

It should also be evident that stations can be easily removed or added to apparatus 24 in order to provide fewer or additional operations. Preferably, however, the number of stations is between 4 and 10, and most preferably is between 6 and 8.

The time allotted for each station can vary and thus, the production rate of the apparatus can also vary. In the embodiment shown herein, the production rate is 600 anodes per hour. However, the preferred production rate is anything over 200 anodes per hour, more preferably greater than 400 anodes per hour, still more preferably greater than 500 anodes per hour, even still more preferably 550 anodes per hour, and most preferably, a production rate of at least 600 anodes per hour.

It is also clear that the process of the present invention can be automated to a significant degree so that the necessary working steps automatically take place in sequence, namely, that the raw anodes one by one enter the anode preparation apparatus from the receiving conveyor. They are then processed, in stages, in order to prepare them for use, and then returned, as processed anodes to the discharge conveyor.

Virtually all of the system, or its various components, are preferably controlled by a programmable logic controller. This approach makes it possible to operate the system continuously in a completely automatic mode. As such, the system can operate without the need for human intervention, and thus the safety of the operation is self-evident.

Further, when compared to prior art systems, and most notably, prior art carousel systems, it is to be noted that the system of the present invention transfers anodes from station to station on a rotary table in a flat, horizontal position, with the lugs facing the outside perimeter of the machine. This is clearly in contrast to the carousel system which transfers the anodes in a vertical position. This horizontal configuration permits a higher speed for transfer of the anode between operating stations for the following two reasons: first, the anode body is located much closer the pivot point of the system, than with a carousel, resulting in a much reduced radius of gyration, of both the rotating mechanism, and the combined set of anodes. As such, the forces and work required to transfer the anodes between operating station, in a given time are much reduced.

Second, the anodes can be positively clamped onto a rotary table, permitting very rapid motion without any risk of anodes shifting or swinging, and without requiring external fixed guides that may wear or become damaged by misshapen anodes.

These benefits permit the system of the present invention to provide an operation to operation transfer rate of as little as, for example, 1.5, 1.25, or most preferably 1.2 seconds, or less. In particular, in the design embodiment shown in the figures, with a 1.2 second transfer time between operations, an operational capacity for the system can be obtained of up to 600 APH, or even higher.

Further, it is to be noted that the base and entire rotary platform, drive mechanisms and anode support table are incorporated in a single small unit, having a small footprint. As a result, the electrorefining anode preparation apparatus of the present invention can be manufactured and assembled as a single deliverable unit, with little or no hydraulics or field millwrighting required, other than a basic leveling of the base. This dramatically reduces installation time and cost.

Further, the design of the present system allows it to be installed in smaller working areas. Further, the incorporation of robots to perform the loading and unloading operations, allows the system to feed anodes from any direction. This allows the system to work with a wider range of plant geometries, and without millwrighting of transfers. Further, with the incorporation of robots to perform the loading and unloading operations, the orientation of the anode can be easily modified.

Thus, it is apparent that there has been provided, in accordance with the present invention, an electrorefining anode preparation apparatus and process which fully satisfies the goals, objects, and advantages set forth hereinbefore. Therefore, having described specific embodiments of the present invention, it will be understood that alternatives, modifications and variations thereof may be suggested to those skilled in the art, and that it is intended that the present specification embrace all such alternatives, modifications and variations as fall within the scope of the appended claims.

Additionally, for clarity and unless otherwise stated, the word "comprise" and variations of the word such as "comprising" and "comprises", when used in the description and claims of the present specification, is not intended to exclude other additives, components, integers or steps.

Moreover, the words "substantially" or "essentially", when used with an adjective or adverb is intended to enhance the scope of the particular characteristic; e.g., substantially planar is intended to mean planar, nearly planar and/or exhibiting characteristics associated with a planar element.

Further, use of the terms "he", "him", or "his", is not intended to be specifically directed to persons of the masculine gender, and could easily be read as "she", "her", or "hers", respectively.

Also, while this discussion has addressed prior art known to the inventor, it is not an admission that all art discussed is citable against the present application.

I claim:

1. An electrorefining anode preparation apparatus comprising:

a base;

a moveable rotating platform and means for rotating the platform relative to said base, in a controlled fashion;

an anode receiving means on said platform which is adapted to receive and hold a raw anode in an essentially horizontal orientation, and supply said anode to an anode treatment station in a horizontal orientation;

one or a plurality of anode treatment stations located around said rotary platform, whereby said anode can be progressively moved, in series, from said anode receiving means to any or all of said anode treatment stations, in an essentially horizontal orientation, in order to prepare a processed anode;

an anode discharge means on said platform which is adapted to receive said processed anode from anode treatment stations, and discharge said processed anode from said anode preparation apparatus in an essentially horizontal orientation.

2. An apparatus as claimed in claim 1 wherein said means for rotating the platform is a high speed servo-electric motor.

3. An apparatus as claimed in claim 2 wherein said apparatus can rotate from one station to the next in 1.2 seconds.

4. An apparatus as claimed in claim 1 wherein the centre of gravity of each anode is equally spaced around the center of said rotating platform.

5. An apparatus as claimed in claim 4 wherein said anode centre of gravity is within 2 meters of the centre of said rotating platform.

6. An apparatus as claimed in claim 1 wherein the number of anode treatment stations is between 4 and 10.

7. An apparatus as claimed in claim 6 wherein the number of anode treatment stations is between 6 and 8.

8. An apparatus as claimed in claim 1 wherein said anodes are horizontally orientated with said lugs being located radially away from the centre of said platform.

9. An apparatus as claimed in claim 1 wherein said anode treatment stations comprise an anode body press, a lug press, or a lug mill.

10. An apparatus as claimed in claim 9 wherein said anode body press comprises a series of hydraulic rams that press onto the body of said raw anode.

11. An apparatus as claimed in claim 1 wherein said anode body press components are located above and below the anode.

12. An apparatus as claimed in claim 1 wherein said raw anode is held in place on support arms using hydraulically operated anode clamps.

13. An apparatus as claimed in claim 1 wherein said apparatus has six sets of support arms which are equally spaced radially around said apparatus so as to be 60° from each other.

14. An apparatus as claimed in claim 9 wherein said lug press straightens or bends lugs on said raw anode using hydraulic rams.

15. An apparatus as claimed in claim 9 wherein said lug mill cuts said lugs using a lug cutter means.

16. An anode processing system comprising an anode receiver, an anode preparation apparatus, as claimed in claim 1, and an anode receiver and an anode discharger.

17. An anode processing system as claimed in claim 16 additionally comprising a receiving conveyor wherein the raw anodes are hung by their lugs in an essentially vertical orientation, and a discharge conveyor wherein the processed anodes are hung by their lugs in an essentially vertical orientation.

18. An anode processing system as claimed in claim 17 wherein said anode receiver for receiving a raw anode in an essentially vertical orientation from said receiving conveyor comprises means for grasping and holding a raw anode on said receiving conveyor system; means for rotating said held raw anode from said essentially vertical orientation to an essentially horizontal orientation; and means for transferring the horizontally orientated raw anode to said anode receiving means on said anode preparation apparatus.

19. An anode processing system as claimed in claim 17 wherein said anode discharger for discharging a processed anode in an essentially vertical orientation from said anode preparation apparatus comprises means for grasping and holding an essentially horizontal, processed anode from said anode discharge means on said anode preparation apparatus; means for rotating said held processed anode from an essentially horizontal orientation to an essentially vertical orientation; and means for transferring the vertically orientated process anode said discharge conveyor.

20. An anode processing system as claimed in claim 17 wherein said anode receiver and anode discharger are both automated robotic devices, each of which comprises grasping and holding arms capable of grasping and holding a raw or processed anode, means for rotation of said raw or processed anodes from an essentially vertical orientation to an essentially horizontal orientation, or vice versa, and means to move said raw or processed anode between said anode preparation apparatus and said receiving or discharge conveyors.

21. An anode processing system as claimed in claim 20 wherein said anode receiver and anode discharger are programmable industrial robots having hydraulically operated arms.

22. An anode processing system as claimed in claim 20 wherein said anode receiver and anode discharger have a rotatable joint for movement of an anode from a horizontal to vertical orientation, or from a vertical to horizontal orientation, and a telescopic arm for movement of said anode.

23. An electrorefining anode preparation process comprising:

presenting an essentially vertically orientated raw anode from a receiving conveyor to an anode receiver;

grasping and holding said raw anode with said anode receiver;

rotating said raw anode to an essentially horizontal orientation and presenting said horizontally orientated raw anode to an anode preparation station;

receiving said raw anode on a platform on said anode preparation station using an anode receiving means;

rotating said platform to move said raw anode, in series, from said anode receiving means to one or a plurality of anode treatment stations;

treating said raw anode in said anode treatment stations, while said raw anode is in an essentially horizontal orientation, in order to produce a processed anode;

rotating said platform to move said processed anode to an anode discharge means;

releasing said processed anode from said anode discharge means, and grasping and holding said processed anode from said anode discharge means using an anode discharger;

rotating said processed anode to an essentially vertical orientation and preparation station;

discharging said processed anode, in an essentially vertical orientation, from said anode discharger to a second conveyor means.

24. A process as claimed in claim 23 wherein the longest processing time for any treatment station is equal to, or less than 4.8 seconds.

25. A process as claimed in claim 23 wherein said apparatus is rotated from one treatment station to an adjacent treatment station in 1.2 seconds, or less.

26. A process as claimed in claim 23 which discharges a processed anode every 6.0 seconds, or less.

27. A process as claimed in claim 23 which produces greater than 400 anodes per hour.

28. A process as claimed in claim 23 which produces greater than 550 anodes per hour.

29. A process as claimed in claim 23 which produces anodes at a rate of at least 600 anodes per hour.

30. A process as claimed in claim 23 wherein said raw anode is made of copper, silver, gold, tin, nickel, cobalt, lead or zinc.

31. A process as claimed in claim 30 wherein said raw anode is made of copper.

* * * * *